United States Patent [19]

Miller et al.

[11] Patent Number: 4,915,161

[45] Date of Patent: Apr. 10, 1990

[54] FIN REMOVING METHOD AND APPARATUS

[75] Inventors: Vernon J. Miller; Covert E. Fender, both of Carroll County, Ga.

[73] Assignee: Southwire Company, Carrollton, Ga.

[21] Appl. No.: 223,315

[22] Filed: Jul. 25, 1988

[51] Int. Cl.[4] ..... B22D 11/126

[52] U.S. Cl. ..... 164/460; 29/33 A; 29/33 C; 29/527.6; 164/263; 409/131; 409/293

[58] Field of Search ..... 164/460, 263, 69.1, 164/262; 29/527.6, 33 A, 33 C; 409/138, 139, 131, 132, 293, 298

[56] References Cited

U.S. PATENT DOCUMENTS 3,066,401 12/1962 Morel et al. ..... 29/33 C X 3,469,620 9/1969 Ward et al. ..... 164/460

FOREIGN PATENT DOCUMENTS 54-7497 4/1979 Japan ..... 164/460

56-59519 5/1981 Japan ..... 164/417

57-41876 3/1982 Japan ..... 164/460

58-151940 9/1983 Japan ..... 164/460

*Primary Examiner*—Nicholas P. Godici

*Assistant Examiner*—J. Reed Batten, Jr.

*Attorney, Agent, or Firm*—James W. Wallis, Jr.; Stanley L. Tate

[57] ABSTRACT

A method and apparatus for notching and removing the fin from a continuously cast metal bar, whereby the fin is broken into small pieces for easy handling by using a driven, blade carrying guide assembly.

18 Claims, 1 Drawing Sheet

FIN REMOVING METHOD AND APPARATUS

TECHNICAL FIELD

This invention relates to an improved method and apparatus for the removal of a fin from a continuously cast metal bar. More particularly, it relates to a method and apparatus for notching the fin of a continuously cast bar, prior to said fin's removal, so that when the notched fin is removed by a cutter blade, it breaks into small pieces for easier handling.

BACKGROUND ART

Continuously cast molten metal is well known within the industry. Many methods and devices for continuously casting molten metal exist. One large class of such devices is called band or belt type casters. A common feature of all band or belt type casters is that one or more of the faces of the casting chamber is made up of a movable belt. The interface between such a movable belt and the remaining parts of the casting chamber typically allows some amount of molten metal to escape from the casting chamber, forming what is commonly known as a fin.

In a wheel and band or belt type caster, the flexible band forms one of the sides of the casting chamber It therefore follows that there are two fins produced on such a device. In a four belt casting system, where movable belts are used to form all four sides of a rectangular casting chamber, there are four fins formed.

Early in the development of such casting machines, it was the practice to simply try and minimize the amount of fining that took place on the cast bar. That was attempted by careful attention being paid to the casting system. With more sophisticated uses for the product of such casting systems, it became obvious that the fin on the continuously cast bar could no longer simply be rolled into the final product, it had to be physically removed. Shaving devices were placed between the casting machine and the rolling mill and positioned such that as the cast bar was passed by these devices, they would literally slice the fin off of the continuously cast metal bar. This method of removinq the fin from the bar has been a preferred method, even in light of its draw backs. One draw back of this method of removing the fin from a continuously cast bar is the fin's natural tenancy to form an unbroken curl as it is sliced from the continuously cast bar. These long curls of hot metal wrap themselves around the devices holding the fin removal blades. As the casting operation continues through a work shift, the area around the fin cutting devices becomes totally entangled with these curls of metal which are being removed. Constant attention on the part of a mill attendant is required in order to keep the work area reasonable free of these curls and in a safe working condition.

SUMMARY OF THE INVENTION

Accordingly, it is an object of the present invention to provide a method and apparatus by which fins may be removed from a continuously cast metal bar.

Another object of the present invention is to provide a method and apparatus through which a fin removed from a continuously cast metal bar is removed in a form suitable for easy disposal.

Still another object of the present invention is to provide an economical method of controlling the removal of fins from a continuously cast metal bar.

Yet another object of the present invention is to provide an apparatus that will allow for reasonably maintenance free operation of the fin removal area in a continuously cast metal bar system.

A principal feature of the present invention is the provision of a series of blades that notch the fin of a continuously cast metal bar and thereby contribute to a waste product which will break into small pieces for easy removal.

Another feature of the present invention is the easily replaceable notching blades used to notch the fin of a continuously cast metal bar.

Even another feature of the present invention is the provision of an apparatus that will function without the requirement of an exterior power feed.

And still even another important feature of the present invention is the simplicity of its design.

Yet even another feature of the present invention is the extremely low maintenance and up keep required for its proper operation.

And yet even another feature of the present invention is its lack of required adjustments during its work time.

And another feature of the present invention is its additional utility as a guide for a continuously cast metal bar.

One advantage of the present invention is the rendering of the fins removed from a continuously cast metal bar into small, easily controlled and easily disposed of pieces.

Another advantage of the present invention is in its simplicity and ease of operation.

Still another advantage of the present invention is its low initial cost and operational maintenance.

And another advantage of the present invention is a notching device that, without modification or external power, also serves as a bar guide for a continuously cast metal bar.

In accordance with these and other objects, features, and advantages of the present invention, there is provided a method of and an apparatus for notching and removing a fin from a continuously cast metal bar.

Also, in accordance with the present invention there is provided a method and apparatus for inexpensively controlling the product removed by a fin cutter when used on the fin of a continuously cast metal bar.

Again, in accordance with the present invention, there is provided a material for the notching blades that greatly extends said blades' use life.

The notching blade is removably mounted in a cylindrical carrier, said carrier being about three inches in diameter. When a continuously cast metal bar, with a nominal casting speed of about fifty feet per minute, is in tangential contact with the carrier, the carrier rotates at about 64 revolutions per minute. It follows that each blade contacts the continuously cast bar, said bar being about 1600 degrees F, about one time per second. Each assembly or apparatus is flooded with about 85 degrees F cooling water. This constant and frequent heating and cooling of the blade is extremely severe.

Initially, carbon steel blades were considered as to their suitability for the notching blades. Experience with this material in other applications wherein said material came into contact with hot metal bars indicated that it was not a suitable material.

Tests were conducted with various alloy steels that in theory should have performed in an acceptable manner. Blades made of TANTUNG G lasted less than twenty-four hours. Blades made of 304 stainless steel did little better. The constant heat cycling which the blades were exposed to resulted in short use life expectancies. Samples of INCOLOY 800 were tested and gave a use life of about 100 hours. Samples of INCONEL 625 were tested and it worked in excess of 800 hours. Neither the INCOLOY nor the INCONEL were recommended by the manufacturer as terminal tools for processing hot metals. These alloys are typically recommended as stock for a temperature resistant part rather than a tool type material. Small pieces were tested in hope that the high nickel content would lend some stability to the blade in light of its constant heating and cooling, and in light of the alloy's inherent resistance to high temperature failures.

BEST MODE FOR CARRYING OUT THE INVENTION

Figure 1:
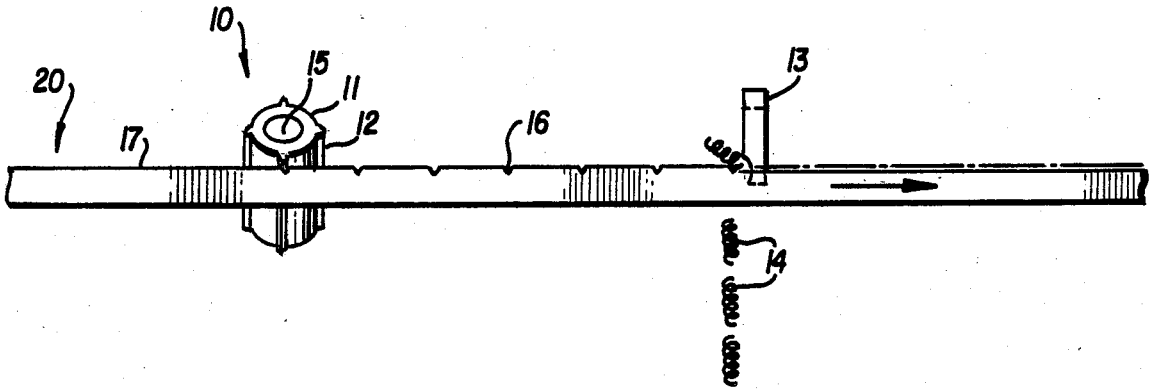
FIG. 1 is a side view of the present invention showing the relative positions of its major components.
Figure 2:
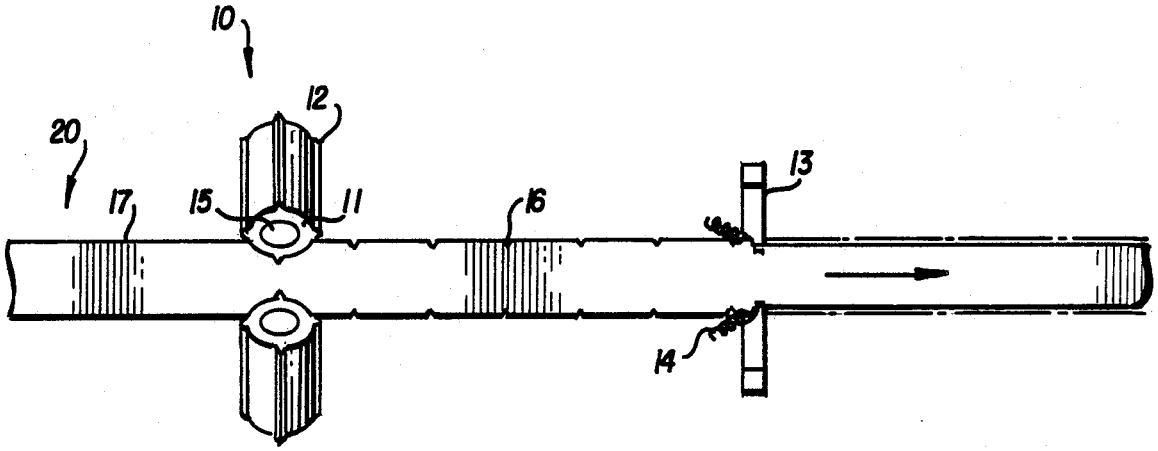
FIG. 2 is a top view of the present invention showing the relative positions of its major components.

Referring now to FIG. 1 and FIG. 2, each being a view of the present invention and each having like numbers to identify the same part in each figure, the preferred embodiment of the present invention is presented.

Continuously cast bar 20 is passed through a plurality of substantially identical notching apparatuses 10 for impressing a notch 16 in fin 17 of said cast bar 20. Notching apparatus 10 contains a plurality of notching blades 12, said blades 12 being impressed into fin 17 of continuously cast bar 20. No material from fin 17 is removed at this point. The result of the impression of blade 12 into fin 17 is a v-shaped indention or notch 16 in fin 17 which facilitates the breaking of fin 17 into small pieces 14 when fin 17 is removed from cast bar 20 by cutter blade 13, said cutter blade 13 being positioned such that as bar 20 passes said blade 13, fin 17 is sliced away from said bar 20 and breaks into said small pieces 14.

Cylindrical carrier 11 is positioned such that tangential contact is made with fin 17 as bar 20 passes. This tangential contact results in rotation of carrier 11 and the resulting v-shaped indentions 16 as blades 12 are impressed into fin 17 of cast bar 20 as said bar 20 passes apparatus 10. As fin 17 is removed by blade 13, impressed notches 16 cause fin 17 to break up into small parts 14. This facilitates the maintenance and removal of fin 17 since small pieces 14 are easier to dispose of and are more manageable than longer pieces.

Radial movement of apparatus 10 away from cast bar 20 is restricted by adjustable rigid mounting (not shown). Movement of cast bar 20 away from apparatus 10 is restricted by guide rollers (not shown).

Although the present invention has been discussed and described with the primary emphasis on one preferred embodiment, it should be obvious that adaptations and modifications can be made thereto without departing from the spirit and the scope of the invention.

What is claimed is:

1. An apparatus consisting of a plurality of substantially identical elements, each element for notching and removing a fin from a continuously cast bar comprising:

a carrying means comprising a cylindrical body having an axial bore, said body being rotatably mounted and positioned such that said cylindrical body rotates about its axis while tangentially contacting a fined corner of a continuously cast bar, a plurality of notching blades secured to said carrying means for notching a fin on a continuously cast bar, and a removing blade for removing said notched fin from said continuously cast bar.

2. The apparatus of claim 1, wherein said notching blades are removably secured to said carrying means.

3. The apparatus of claim 1, wherein said fin removing blade is positioned such that the notched fin of said cast bar is removed as said notched fin passes said fin removing blade.

4. The apparatus of claim 1, wherein rotational movement is accomplished as said cast bar tangentially contacts and rotates said carrying means to which notching blades are removably mounted.

5. The apparatus of claim 1, wherein each said notching blade is positioned such that the resulting notch in said fin of said continuously cast bar is sufficiently deep so as to promote breaking of said fin when said fin is removed by said fin removing blade.

6. The apparatus of claim 1, wherein said notching blades are made from a heat resistant alloy.

7. The apparatus of claim 1, wherein the notching face of said notching blades is a flat face, said face being between 0.005 inches and 0.035 inches wide.

8. The apparatus of claim 1, wherein the notching face of said notching blades is a flat face, said face being about 0.020 inches wide.

9. The apparatus of claim 1, wherein the position of said carrying means is adjustable relative to a finned corner of said continuously cast bar.

10. A method for notching and removing a fin from a continuously cast bar comprising the use of:

a carrying means comprising a cylindrical body having an axial bore, said body being rotatably mounted and positioned such that said cylindrical body rotates about its axis while contacting a finned corner of a continuously cast bar, a plurality of notching blades secured to said carrying means for notching a fin on a continuously cast bar, and a removing blade for removing said notched fin from said continuously cast bar.

11. The method of claim 10, wherein said notching blades are removably secured to said carrying means.

12. The method of claim 10, wherein said fin removing blade is positioned such that the notched fin of said cast bar is removed as said notched fin passes said fin removing blade.

13. The method of claim 10, wherein rotational movement is accomplished as said cast bar tangentially contacts and rotates said carrying means to which notching blades are removably mounted.

14. The method of claim 10, wherein each said notching blade is positioned such that the resulting notch in said fin of said continuously cast bar is sufficiently deep to promote breaking of said fin when said fin is removed by said fin removing blade.

15. The method of claim 10, wherein said notching blades are made from a heat resistant alloy.

16. The method of claim 10, wherein the notching face of said notching blades is a flat face, said face being between 0.005 inches and 0.035 inches wide.

17. The method of claim 10, wherein the notching face of said notching blades is a flat face, said face being about 0.020 inches wide.

18. The method of claim 10, wherein the position of said carrying means is adjustable relative to a finned corner of said continuously cast bar.

* * * * *